US006434750B1

(12) United States Patent
Hunter

(10) Patent No.: US 6,434,750 B1
(45) Date of Patent: Aug. 20, 2002

(54) INFANT CARRIER COVERING

(76) Inventor: Shelley Anne Hunter, 1012 Wild Oak Ct., Concord, CA (US) 94521

( * ) Notice: Subject to any disclaimer, the term of this patent is extended or adjusted under 35 U.S.C. 154(b) by 0 days.

(21) Appl. No.: 09/751,914

(22) Filed: Dec. 26, 2000

(51) Int. Cl.[7] ..... A41D 3/08
(52) U.S. Cl. ..... 2/88; 2/104; 224/159
(58) Field of Search ..... 2/69, 88, 80, 83, 2/49.1–49.3, 46, 108, 48, 93, 75, 102, 114, 84, 69.5; 224/155, 158, 159, 160

(56) References Cited

U.S. PATENT DOCUMENTS

| | | | | | |
|---|---|---|---|---|---|
| 336,124 | A | * | 2/1886 | Levy | 2/108 |
| 3,370,303 | A | * | 2/1968 | Tempelhof | 2/88 |
| 4,492,326 | A | * | 1/1985 | Storm | 224/160 |
| 4,606,078 | A | * | 8/1986 | Tkacsik | 2/84 |
| 4,987,612 | A | * | 1/1991 | Middleton | 2/104 |
| 5,034,999 | A | * | 7/1991 | Lubbers | 2/104 |
| 5,182,813 | A | * | 2/1993 | Booze | 2/104 |
| 5,259,068 | A | * | 11/1993 | Carroll | 2/104 |
| 5,544,364 | A | * | 8/1996 | Weber | 2/104 |

* cited by examiner

*Primary Examiner*—Gloria M. Hale
*Assistant Examiner*—Tejash Patel
(74) *Attorney, Agent, or Firm*—Risto A. Rinne, Jr.

(57) ABSTRACT

An apparatus for covering an infant that is placed in a front-worn type of infant carrier includes a flexible center panel that includes a pair of arcuate sides that curve inward proximate the vertical center of the center panel. A pair of flexible side panels each include a pair of opposite outwardly curved edges that are each attached on one side to one of the arcuate sides of the center panel. An adjustable neck strap that is attached to the center panel is placed around the neck of the person using the apparatus. The person attaches the front-worn infant carrier to the front of their person and then places the infant therein, either facing the infant rearward or facing forward. The apparatus is then secured about the neck of the person and is allowed to drape over the infant carrier and the infant therein, thereby protecting the infant from the sun and elements. A modified flexible carrier apparatus includes a pair of inside pockets that each include a separable portion to allow for the making of direct contact with the infant and a plurality of closures that are-disposed along an edge on either side thereof and which are useful to take up slack.

16 Claims, 2 Drawing Sheets

INFANT CARRIER COVERING

BACKGROUND OF THE INVENTION

1. Field of the Invention

The present invention, in general relates to coverings used to protect infants from the sun and elements and, more particularly, to devices that protect them when they are being transported in a front-wearing type of carrier.

When an infant is being carried in a baby carrier (also referred to as an infant carrier) of the type that supports the infant in front of the person, the infant is exposed to the sun and various elements.

Doctors do not recommend putting sunscreen on babies (i.e., infants) under the age of six months. Therefore, it is important to block exposure of the infant to the sun.

A hat only covers the head. A blanket may be too hot and it also requires constant use of the caregiver's hands to support it over the infant, thereby defeating some of the reasons for using a "hands-free" baby carrier.

Furthermore, a blanket does not work for an outward-facing baby.

In addition, the infant may, at times, require protection from certain other elements such as wind, rain, snow, and cold.

Also, insects can annoy and bite an infant and may also present a risk of passing a communicable disease to the infant. For example, mosquitoes may transmit encephalitis and other serious diseases.

A nursing blanket, having a strap, provides hands-free utility, but does not possess a shape suitable to hold it in place and as such can fly in the wind where it is unable to stay in position. It also does not work for an outward-facing baby because it has no opening that faces outward.

A young baby typically is positioned so as to face toward the person that is supporting the infant, whereas a somewhat older infant is normally faced outward, and away from the supporting person. A blanket or a nursing blanket would not permit an outward facing infant to see.

There are various types of netting and shields that are designed for use with a stroller, but none of these types of devices work with a baby carrier.

Furthermore, when supporting an infant, there is a desire for the parent, especially the mother, to make physical touch with the infant. This is reassuring to the infant/baby as well as to the parent that is carrying the baby. Anything, that promotes the closeness of hand contact from parent to child is desirable because this helps to promote both a sense of well being as well as to further emotional bonding.

There is yet another need for pockets to conveniently carry whatever items are immediately required. These items may include formula for a nursing infant to house keys to a spare diaper and cleaning cloth.

Accordingly, there exists today a need for an infant carrier covering for use with a front-worn type of a baby (infant) carrier that provides protection from the sun and elements and promotes the various objectives herein described.

Clearly, such an apparatus would be a useful and desirable device.

2. Description of Prior Art

Coverings of all manner are, in general, known. For example, the following patents describe various types of these devices:

U.S. Pat. No. 416,970 to Taylor, Dec. 10, 1889;
U.S. Pat. No. 2,674,738 to Mehlos, Apr. 13, 1954;
U.S. Pat. No. 4,009,808 to Sharp, Mar. 1, 1977;
U.S. Pat. No. 4,106,122 to Dodd, Aug. 15, 1978;
U.S. Pat. No. 4,333,591 to Case, Jun. 8, 1982;
U.S. Pat. No. 4,468,816 to Kanfer, Sep. 4, 1984;
U.S. Pat. No. 4,492,326 to Storm, Jan. 8, 1985;
U.S. Pat. No. 4,606,078 to Tkacsik, Aug. 19, 1996;
U.S. Pat. No. 4,778,091 to Barto, Oct. 18, 1988;
U.S. Pat. No. 4,989,268 to Stolhand, Feb. 5, 1991;
U.S. Pat. No. 4,995,116 to Beauchamp et al., Feb. 26, 1991;
U.S. Pat. No. 5,038,411 to St. Armand, Aug. 13, 1991;
U.S. Pat. No. 5,220,692 to Cox, Jun. 22, 1993;
U.S. Pat. No. 5,259,068 to Carroll, Nov. 9, 1993;
U.S. Pat. No. 5,437,061 to Kenner, Aug. 1, 1995;
U.S. Pat. No. 5,570,474 to Berry et al., Nov. 5, 1996;
U.S. Pat. No. 5,609,279 to O'Shea, Mar. 11, 1997;
U.S. Pat. No. 5,611,095 to Schneider, Mar. 18, 1997;
U.S. Pat. No. 5,652,960 to Kaknevicius, Aug. 5, 1997;
U.S. Pat. No. 5,946,725 to Shatzkin et al., Sep. 7, 1999;
U.S. Pat. No. 5,950,2135 to Tata, Sep. 14, 1999;
U.S. Pat. No. 5,956,766 to Benway, Sep. 28, 1999; and
U.S. Pat. No. 5,956,767 to Imm, Sep. 28, 1999.

While the structural arrangements of the above described devices, at first Appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an infant carrier covering that is adapted for use with a front-worn infant carrier.

It is also an important object of the invention to provide an infant carrier covering that can protect an infant from exposure to the sun.

Another object of the invention is to provide an infant carrier covering that can protect an infant from rain.

Still another object of the invention is to provide an infant carrier covering that can protect an infant from snow.

Still yet another object of the invention is to provide an infant carrier covering that can protect an infant from cold.

Yet another important object of the invent-ion is to provide an infant carrier covering that can protect an infant from insects.

Still yet another important object of the invention is to provide an infant carrier covering that can protect an infant from mosquitoes.

Still yet one other important object of the invention is to provide an infant carrier covering that can protect an infant from the heat.

One further object of the invention is to provide an infant carrier covering that includes a VELCRO adjusting neck strap.

One yet further object of the invention is to provide an infant carrier covering that includes pockets.

One still further object of the invention is to provide an infant carrier covering that includes a VELCRO opening disposed in a pocket to allow contact directly with the infant that is being carried.

Briefly, an infant carrier covering for use with a front-worn infant carrier that is constructed in accordance with the principles of the present invention has a flexible fabric covering that is formed of any desired material, such as a light cotton knit, a jersey knit, a water-repellent exterior, or a mesh netting. The infant carrier covering is held in place proximate the person that is supporting the infant carrier (and also the infant that is placed in the infant carrier) by an adjustable strap that is placed around the person's neck and which includes two ends, each end being attached to a top of the infant carrier covering. The infant carrier covering includes three fabric panels, a center panel and a pair of side panels, each side panel being disposed on opposite sides of the center panel. The center panel is generally of a rectangular shape with a width that is sufficient to cover the infant's body and it includes a length that is sufficient to cover the infant, as desired. The center panel includes on each side thereof a first inward arcuate portion and a second inward arcuate portion. Therefore, the center panel is widest at the top and bottom ends thereof. The two side panels include a first outward arcuate portion and a second outward arcuate portion respectively that are attached to the first and second inward arcuate portions of the center panel. The side panels also include a third and a fourth outward arcuate portion that is disposed opposite the first and second outward arcuate portions. The first, second, third, and fourth outward arcuate portions of the side panels provide for a shape that is narrower at both the top and bottom ends thereof. The first outward arcuate portion of the first side panel is attached to the first inward arcuate portion and the second outward arcuate portion of the second side panel is attached to the second inward arcuate portion where they form a three dimensional shape for the covering that tends to curve it around the infant and back toward the person. The center panel includes a slit (i.e., a vertical opening) along at least a portion of its length that can be opened or closed as desired to permit a front-facing infant's head to protrude and to provide forward visibility for the infant. If the vertical opening is extended along the entire length (i.e., height) of the center panel it splits the center panel into a first center panel and a second center panel portion. Optional weights and additional straps may also be included, as desired, to better secure the infant carrier covering in position. According to a modification, a seven panel design of modified infant carrier covering includes a VELCRO adjusting neck strap and inside retrievable pockets that are lined on at least one side thereof with VELCRO. When the VELCRO is closed, a conventional pocket is provided. When the VELCRO is opened, the user can slip his or her hands through the opening and make direct contact with the infant. The modified infant carrier also includes, preferably a snap closure that extends approximately one-half the front height of the modified carrier to facilitate the carrying of a front-facing infant.

DETAILED DESCRIPTION OF THE INVENTION

Figure 1:
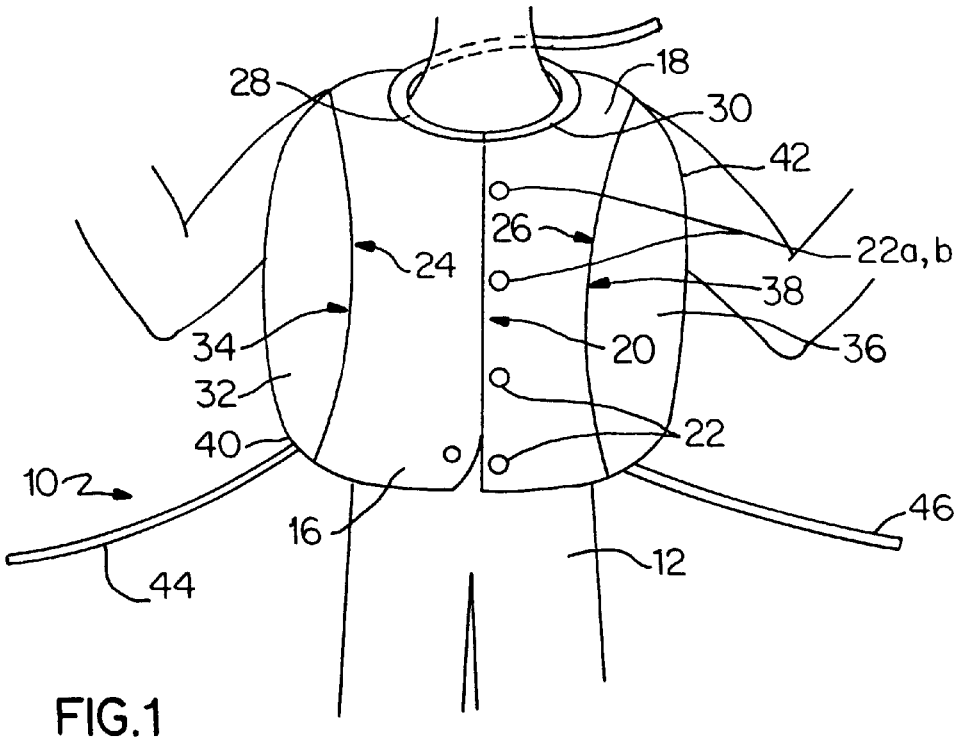
FIG. 1 is a view in perspective of the front of an infant carrier covering that is disposed over an infant carrier (not showing the infant).
Figure 2:
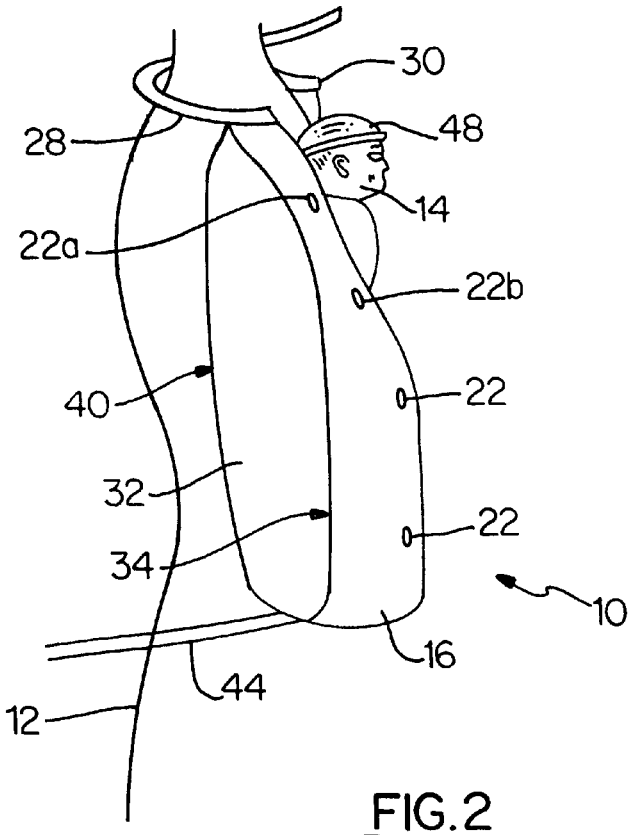
FIG. 2 is a view in perspective of the side of an infant carrier covering that is disposed over an outward-facing infant in an infant carrier.

Referring to FIG. 1 and also on occasion to FIG. 2 is shown, an infant carrier covering, identified in general by the reference numeral 10. The terms "infant" and "baby" may be used interchangeably although the term baby often applies to those infants that are recently or newly born.

A conventional type of a front-wearing infant carrier is not shown in the drawing figures but is attached to a person 12 and is used to support an infant 14 therein.

Such types of infant carriers are common devices and are manufactured under the various tradenames of "BABY BJORN", "SNUGLI", and others. They are secured to the person 12 by straps (not shown) and are not described in detail herein because a detailed description of their use is not required for an understanding of the benefits and advantages of the infant carrier covering 10. These types of infant carriers generally include a pouch area with two holes disposed in the bottom thereof into which the infant 14 is placed, a leg of the infant 14 protruding through each of the two holes and dangling underneath.

A first center panel 16 and a second center panel 18 include a combined width that is sufficient to cover the infant 14 as well as the infant carrier.

The first center panel 16 and the second center panel 18 are separated by a vertical opening 20.

Both center panels 16, 18 may be secured in a closed position (FIG. 1) or in an open position (FIG. 2) by the use of fasteners 22 that connect the two center panels 16, 18 together.

The fasteners 22 may include any preferred type such as VELCRO hook and loop, buttons, or snaps and they are normally secured together (i.e., closed) when the infant 14 is rear-facing (i.e., toward the person 12) and a few of the fasteners 22*a*, 22*b* are normally opened when the infant 14 is forward-facing (i.e., away from the person 12) to allow exposure for the head of the infant 14 and to permit the infant 14 to look forward.

The first center panel 16 includes a first inward arcuate portion 24 extending from the top to the bottom that is disposed on the opposite side of the first center panel 16 with respect to the vertical opening 20. The second center panel 18 includes a second inward arcuate portion 26 extending from the top to the bottom that is also disposed on the opposite side of the second center panel 18 with respect to the vertical opening 20.

Accordingly, the first and second center panels 16, 18 each generally include a rectangular shape that is widest at both the top and bottom ends thereof and is narrowest in the center.

An adjustable neck strap includes a first half 28 that is attached to the first center panel 16 and a second half 30 that is attached to the second center panel 18 at one end thereof. The first and second halves 28, 30 may be tied together or are otherwise detachably attachable with respect to each other by the use of any preferred type of fastening device (not shown).

The first and second halves 28, 30 are placed around the neck of the person 12 and are used to secure the top of the infant carrier covering 10 to the person 12 and to allow the rest of the infant carrier covering 10 to drape down over the infant 14 and over the infant carrier.

According to a modification the vertical opening 20 are not extended along the entire height of the first and second center panels 16, 18 but are joined together at the bottom so as to form one larger modified center panel (not shown). A modified vertical opening (not shown) does not extend the entire height of the modified center panel.

However, this configuration is not preferred because the use of the vertical opening 20 permits opening the entire front of the infant carrier covering 10. This makes it faster and easier to attach or to remove the infant carrier covering 10 from a position of cooperation proximate the person 12.

A first side panel 32 includes a first outward arcuate portion 34 that extends along the first side panel's 32 vertical length. The first outward arcuate portion 34 matches the curvature of the first inward arcuate portion 24 of the first center panel 16 and is attached thereto.

A second side panel 36 includes a second outward arcuate portion 38 that extends along the second side panel's 36 vertical length. The second outward arcuate portion 38 matches the curvature of the second inward arcuate portion 26 of the second center panel 18 and is attached thereto.

These matching curvatures when joined together provide a three dimensional shape to the infant carrier covering 10 that tends to offset the plane of the first and second side panels 32, 36 at an angle with respect to the plane of the first and second center panels 16, 18, respectively that brings the first and second side panels 32, 36 back toward the person 12.

The first side panel 32 includes a third outward arcuate portion 40 and the second side panel 36 includes a fourth outward arcuate portion 42. The third and fourth outward arcuate portions 40, 42 extend the infant carrier covering 10 to the rear of the person 12, thereby providing additional protection for the infant 14 from the sun (not shown) and other elements.

The first and third outward arcuate portions 34, 40 of the first side panel 32 and the second and fourth outward arcuate portions 38, 42 of the second side panel 36 provide a shape for each of the two side panels 32, 36 that is widest at the top and bottom and narrowest in the middle area thereof, similar to the cross-section of a convex lens.

Any type of flexible fabric may be used to form the various panels of the infant carrier covering 10, as desired, depending upon the application. For example, a lightweight cotton fabric may be used to provide protection from the sun while a jersey-knit interior combined with a water-repellent exterior covering may be used to provide protection for the infant 14 from wind, rain, snow, and cold. Similarly a mesh fabric may be used to provide protection for the infant 14 from insects.

If desired, when a mesh is used, an optional first elastic draw string 44 is attached to the bottom of the infant carrier covering 10 on one side and a second elastic draw string 46 is attached at the remaining side. The first and second elastic draw strings 44, 46 are pulled and fastened together and are used to draw the bottom of the infant carrier covering 10 tight against the person 12 so as to prevent insects from entering.

In use, the infant 14 is placed in the infant carrier. The infant carrier covering 10 is placed over the infant 14 and over the infant carrier and is held in place by the first and second halves 28, 30 of the adjustable neck strap. If the infant 14 is rear-facing the fasteners 22 may remain closed. If the infant 14 is forward-facing at least a few of the uppermost fasteners 22*a*, 22*b* are opened to allow the infant's head to protrude. To provide protection from the sun, a cap 48 may be placed on the head of the infant 14.

The first and second elastic draw strings 44, 46 are tightened, as desired. Removal is accomplished in the opposite manner.

Figure 3:
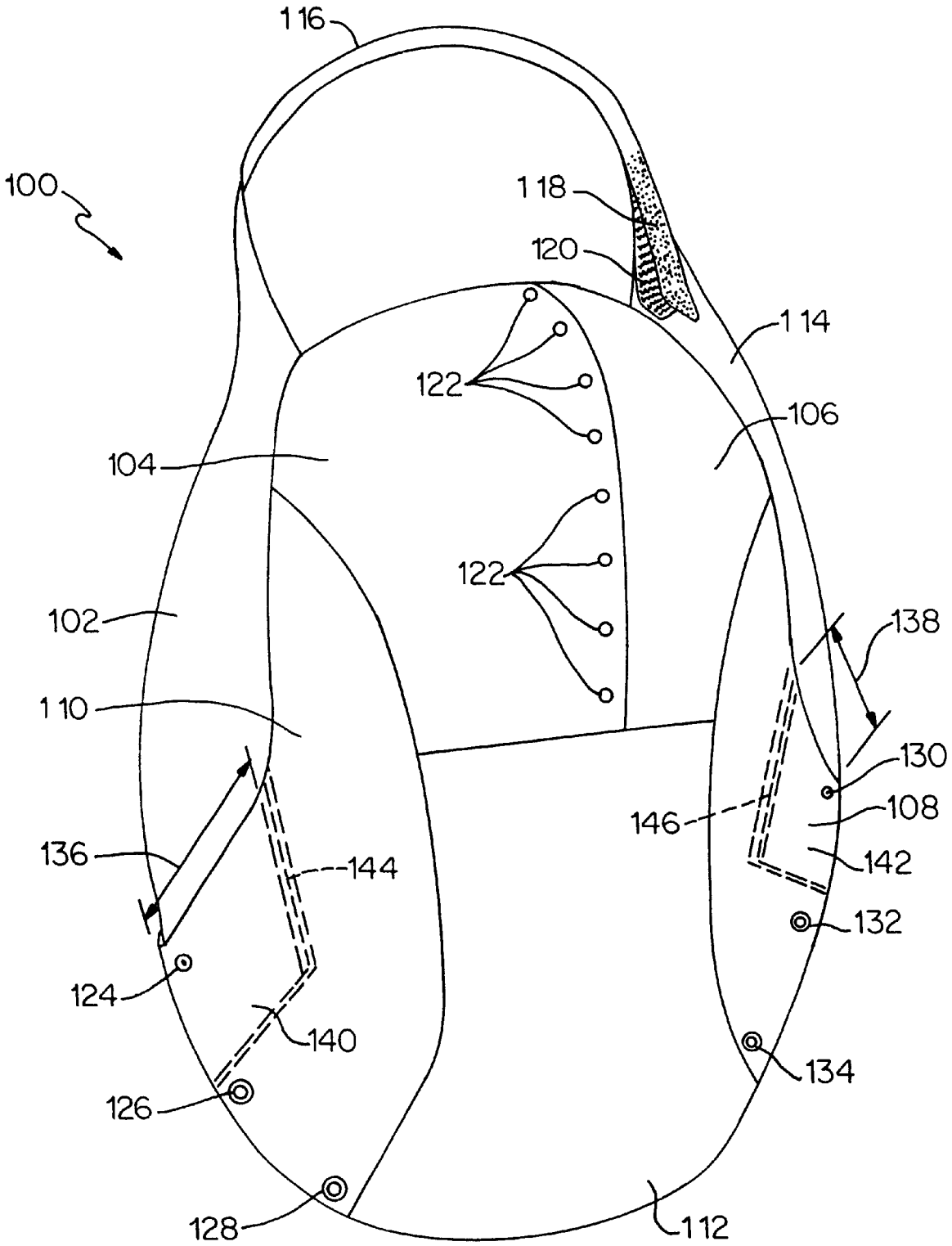
FIG. 3 is a view in perspective of a modified type of an infant carrier covering.

Referring now to FIG. 3, a modified type of infant carrier 100 includes a first of seven flexible panels through the seventh of seven flexible panels, identified by the reference numerals 102, 104, 106, 108, 110, 112, 114, respectively.

The seven panels 102, 104, 106, 108, 110, 112, 114 are sewn together to form the modified carrier 100 having a shape that approximates a segment of a sphere with the inside of the segment facing the caregiver (not shown).

The modified carrier 100 is worn by the caregiver and it surrounds the infant or baby (not shown) that is placed in a front-facing baby carrier (not shown to better illustrate details of construction of the modified carrier 100).

The second and third panels 104, 106 form a center top portion of the modified carrier 100. The second and third panels 104, 106 are permanently attached at an upper portion thereof to the first and seventh panels 102, 114 respectively.

The second and third panels 104, 106 are permanently attached, at a lower portion thereof, to the fifth and fourth panels 110, 108 respectively.

A bottom end of the second and third panels 104, 106 is attached to the top of the sixth panel 112.

The sixth panel is solid and therefore, does not open, It is permanently attached to the fifth panel 110 on one side thereof and to the fourth panel 108 at an opposite side thereof.

The left side of the fifth panel 110 is attached to the first panel 102 below where the second panel 104 is attached to the first panel 102.

The right side of the fourth panel 108 is attached to the seventh panel 114 below where the third panel 106 is attached to the seventh panel 114.

An upper portion of the first panel 102 tapers off and forms a modified neck strap 116 that is adapted to extend around the back of the neck of the user. The modified neck strap 116 includes a first half of a hook and loop fastener 118 (i.e., VELCRO) attached along a portion thereof of an end that is distally disposed with respect to the first panel 102.

An upper portion of the seventh panel 114 includes a corresponding second half of a hook and loop fastener 120 that is adapted to detachably-adhere to the first half of a hook and loop fastener 118. By adjusting the placement of the first half 118 with respect to the second half 120, a method to raising or lowering the modified carrier 100 with respect to the user is provided.

The second and third panels 104, 106 contact each other along a vertical inside edge thereof and are detachably-attachable with respect to each other along the vertical inside edge. A plurality of first closures 122 (one half thereof being attached to the second panel 104 and the remaining half being attached to the third panel 106) are used to detachably-attach the inside edges thereof to each other.

While snap closures are preferred for the first closures 122, if desired, VELCRO, buttons, or other methods may be used to provide the necessary detachable-attachment that is required. When the infant is to face forward, as many of the first closures 122 are opened as is preferred. This then permits the head of the infant to peer through the resulting space that is formed intermediate the second and the third 104, 106 panels.

A first half of a second closure 124 is attached to the fifth panel 110 near an outside edge where the fifth panel 110 is attached to the first panel 102. A plurality of second halves of a second closure 126, 128 are disposed along the outside edge of the fifth panel 110 distally from the firsts half of a second closure 124.

A first half of a third, closure 130 is attached to the fourth panel 108 near an outside edge where the fourth panel 108 is attached to the seventh panel 114. A plurality of second halves of a third closure 132, 134 are disposed along the outside edge of the fourth panel 108 distally from the first half of a third closure 130.

If desired, one of the second halves of a second closure 126 is attached to the first half of a second closure 124 and one of the second halves of a third closure 132 is attached to the first half of a third closure 130.

This decreases the effective length of the outside edges of the fifth and fourth panels 110, 108 which tends to tighten the fit of the bottom of the modified carrier 100 around the feet (not shown) of the infant that is being carried in the front-facing infant carrier over which the modified carrier 100 is placed. This is useful to keep the modified carrier 100 in position in the wind.

If an even tighter fit is desired, another of the second halves of a second cl sure 128 is instead attached to the first half of a second closure 124 and another of the second halves of a third closure 134 is instead attached to the first half of a third closure 130.

While snap closures are preferred for the second and third closures 124, 130 if desired, VELCRO, buttons, or other methods may be used to provide the necessary detachable-attachment means that is required.

A first opening is provided along a first segment, identified by a first arrow 136, between the first and fifth panels 102, 110. A similar second opening is provided along a second segment, identified by a second arrow 138, between the seventh and fourth panels 114, 108.

The first and second openings allow access to a first and a second inside pocket 1 40, 142, both of which are shown in dashed lines (because they are disposed behind the fifth and fourth panels 110, 108, respectively).

A first inside edge 144 of the first pocket 140 and a second inside edge 146 of the second pocket 142 each contain a detachably-attachable seam that includes a first half of a hook and loop fastener (VELCRO) on one side thereof and a second half of a hook and loop fastener (VELCRO) on the remaining side thereof.

When the corresponding VELCRO halves of the first inside edge 144 are in contact with each other, the seam is sealed and the first pocket 140 is able to retain whatever items are placed therein.

When the corresponding VELCRO halves of the second inside edge 146 are in contact with each other, the seam is sealed and the second pocket 142 is able to retain whatever items are placed therein.

When the corresponding VELCRO halves of the first inside edge 144 are urged apart from each other, such as when the hand of user supplies a sufficient force to urge them apart, the seam is opened and the hand of the user is free to pass beyond the first pocket 140 and underneath the modified carrier 100 where it can make contact directly with the infant that is in the front-facing infant carrier.

When the corresponding VELCRO halves of the second inside edge 146 are urged apart from each other, such as when the hand of user supplies a sufficient force to urge them apart, the seam is opened and the hand of the user is free to pass beyond the second pocket 142 and underneath the modified carrier 100 where it can make contact directly with the infant that is in the front-facing infant carrier.

Accordingly, the user is able to place both hands directly on the infant when desired. This is useful to bond with the infant and to provide reassurance of the type that only physical touch can provide, as needed.

When the hands are withdrawn from contact with the infant and also from the pockets 140, 142, the first and second inside edges 144, 146 of the first and second pockets 140, 142 make contact with each VELCRO half to reseal each of the pockets 140, 142.

If desired, a draw string (not shown) can be used in place of the second closures 124, 126, 128 and the third closures 130, 132, 134 to adjust the fit.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An infant covering that is secured to a person and is intended for use with an infant placed in a front-worn type of infant carrier, comprising:

(a) a center panel including a first inward arcuate portion that extends an amount that is equal to a height of said center panel disposed on one side thereof and a second inward arcuate portion that extends an amount that is equal to a height of said center panel disposed on an opposite side thereof;

(b) an adjustable neck strap attached to said center panel and adapted to retain said infant covering proximate said person;

(c) a first side panel that includes a first outward arcuate portion that extends the height of said first side panel disposed on one side thereof and a third outward arcuate portion that extends the height of said first side panel disposed on an opposite side thereof and wherein said first outward arcuate portion is attached to said first inward arcuate portion of said center panel and wherein the curvature of said first outward arcuate portion matches the curvature of said first inward arcuate portion;

(d) a second side panel that includes a second outward arcuate portion that extends the height of said second side panel disposed on one side thereof and a fourth outward arcuate portion that extends the height of said second side panel disposed on an opposite side thereof and wherein said second outward arcuate portion is attached to said second inward arcuate portion of said center panel and wherein the curvature of said second outward arcuate portion matches the curvature of said second inward arcuate portion; and wherein said center panel and said first and said second side panels are formed of a flexible fabric material; and wherein said flexible fabric includes a mesh netting and wherein said mesh netting includes elastic means attached to a bottom end of said infant covering, said elastic means adapted to secure said infant covering to said person sufficient to prevent insects from entering a space intermediate said person and said infant covering.

2. The infant covering of claim 1 wherein said center panel includes an opening extending vertically a predetermined distance, said vertical opening including means for securing said opening in an open and closed position.

3. The infant covering of claim 2 wherein said opening extends the entire length of said center panel thereby separating said center panel into a first and a second center panel when said opening is in said open position.

4. The infant covering of claim 1 wherein said adjustable neck strap includes means for fastening said strap about the neck of said person.

5. The infant covering of claim 4 wherein said adjustable neck strap includes a first segment attached to said center panel and a second segment attached to said center panel and means for connecting said first segment to said second segment sufficient to maintain said infant covering proximate said person.

6. The infant covering of claim 1 wherein said flexible fabric includes a cotton fabric.

7. The infant covering of claim 1 wherein said flexible fabric includes a jersey knit.

8. The infant covering of claim 1 wherein said flexible fabric includes a water repellent material.

9. The infant covering of claim 8 wherein said water repellent material is disposed over an inner lining.

10. The infant covering of claim 1 wherein said elastic means includes first elastic means and second elastic means said first and said second elastic means including means for detachably attaching said first and said second elastic means together.

11. An infant covering that is secured to a person and is intended for use with an infant placed in a front-worn type of infant carrier, comprising:

(a) flexible covering means adapted to cover said infant placed in said front-worn type of infant carrier;

(b) a neck strap that is adapted to retain said infant covering proximate said person;

(c) closure means extending vertically along a portion of the vertical length of said flexible covering means, said closure means adapted for opening and closing said portion of the vertical length; and including at least one inside pocket attached to said flexible covering means wherein said at least one pocket includes a portion thereof that includes hook and loop fastening means whereby said fastening means of said portion is adapted to be opened to permit a hand of said person to pass through said pocket and to make contact directly with said infant.

12. The infant carrier of claim 11 including means for adjusting the fit of said carrier around said infant.

13. The infant carrier of claim 12 wherein said means for adjusting the fit includes means for adjusting the length of a portion of an outside edge of said flexible covering means.

14. The infant carrier of claim 13 wherein said means for adjusting the length of a portion of an outside edge includes a first and a second half of a hook and loop fastener attached to said flexible covering means proximate said outside edge.

15. The infant carrier of claim 13 wherein said means for adjusting the length of a portion of an outside edge includes a first and a second half of a snap fastener attached to said flexible covering means proximate said outside edge.

16. The infant carrier of claim 11 wherein said neck strap includes means for adjusting the length thereof.

* * * * *